US006341456B1

(12) United States Patent
Majnaric et al.

(10) Patent No.: US 6,341,456 B1
(45) Date of Patent: Jan. 29, 2002

(54) LONG-SPAN IN-SITU CONCRETE STRUCTURES AND METHOD FOR CONSTRUCTING THE SAME

(75) Inventors: Anton B. Majnaric, Copley; William M. Bjerke, Hudson, both of OH (US)

(73) Assignee: Majnaric Technologies, Inc., Copley, OH (US)

( * ) Notice: Subject to any disclaimer, the term of this patent is extended or adjusted under 35 U.S.C. 154(b) by 0 days.

(21) Appl. No.: 09/467,703

(22) Filed: Dec. 20, 1999

(51) Int. Cl.[7] ..... E04C 3/34

(52) U.S. Cl. ..... 52/224.1; 52/724.5; 52/721.4; 52/651.08; 52/651.07; 52/650.3

(58) Field of Search ..... 52/724.1, 724.5, 52/721.4, 651.08, 651.07, 650.3

(56) References Cited

U.S. PATENT DOCUMENTS

| | | | | | |
|---|---|---|---|---|---|
| 1,936,536 | A | | 11/1933 | Bates | |
| 2,114,773 | A | | 4/1938 | Auten et al. | |
| 2,750,118 | A | * | 2/1956 | Hastings et al. | 238/25 |
| 2,844,023 | A | * | 7/1958 | Maiwurm | 72/61 |
| 3,956,864 | A | | 5/1976 | Fung | 52/414 |
| 3,959,940 | A | | 6/1976 | Ramberg | 52/348 |
| 4,227,829 | A | | 10/1980 | Landry, Jr. | 405/20 |
| 4,313,383 | A | * | 2/1982 | Parazander | 52/724 |
| 4,457,035 | A | | 7/1984 | Habegger et al. | 14/18 |
| 4,865,486 | A | | 9/1989 | Bettigole | 404/75 |
| 5,121,518 | A | | 6/1992 | Muller | 14/21 |
| 5,533,221 | A | | 7/1996 | Majnaric et al. | 14/73 |

FOREIGN PATENT DOCUMENTS

| | | | |
|---|---|---|---|
| SU | 1030462 | 7/1983 | 14/18 |
| SU | 1030463 | 10/1983 | 14/18 |

* cited by examiner

*Primary Examiner*—Carl D. Friedman
*Assistant Examiner*—Christy M. Syres
(74) *Attorney, Agent, or Firm*—Renner, Kenner, Greive, Bobak, Taylor & Weber

(57) ABSTRACT

A long-span structure formed in-situ and extending between supporting structures includes at least two form supports extending between the supporting structures. Each end of the form support includes a bearing plate coupled to the adjacent supporting structure. A plurality of form hangers frictionally engage the form supports, wherein each form hanger has upwardly extending hooks. A beam form is carried by the plurality of form hangers and extends the length of each form support. Each beam form has opposed side walls connected by a bottom to form a cavity. Each sidewall has a downwardly extending hook mating with the upwardly extending hooks. A deck is supported by the beam forms with the cavities remaining open. The concrete is receivable at least in the cavities to form the long-span structure.

22 Claims, 8 Drawing Sheets

LONG-SPAN IN-SITU CONCRETE STRUCTURES AND METHOD FOR CONSTRUCTING THE SAME

TECHNICAL FIELD

The invention herein resides generally in the art of concrete building structures. More particularly, the present invention relates to spans across long distances, utilizing in-situ forms. Specifically, the present invention relates to a structure that facilitates stressing of concrete spans. This is accomplished by installing cables into a form and then placing them under tension against cast-in-place concrete or an external form support. Next, the concrete is poured into the form around the cables. Once the concrete has set, the tension in the cable is released for transfer into the span.

BACKGROUND ART

There are two commonly-used methods for forming long-span concrete structures such as bridges, parking decks, building floors, structures within stadiums, and the like. These structures may be made by either using pre-cast pieces which are manufactured offsite, and then transported to the construction site and assembled. Alternatively, these structures can be manufactured by building the forms on site, pouring concrete into the forms and then removing the forms.

The pre-cast method utilizes standard or special forms which receive concrete or other structural building-type material. After an appropriate curing time, the form is opened and the piece is removed. Reinforcing members may be included in the form if desired. Utilizing such forms allows the manufacturer to efficiently build a large number of building components to a particular specification depending upon end-use. Although this method is effective, there are high costs involved in shipping and erecting the pre-cast pieces. Additionally, the cost of craning the large weight of pre-cast pieces into place adds significant extra cost to high-rise structures.

The other common method for forming long-span concrete structures is where the forms are assembled on site with the desired reinforcing structure. In some instances, significant site preparations are required. Next, the concrete is poured into the form, and after it has set, the forms are removed. This method is also costly inasmuch as the site must be properly prepared to accommodate the form and supporting structure and then the supporting structure must be torn down, cleaned and removed or reinstalled after completion of the concrete pour and setting thereof. Forming the concrete members in place is quite expensive for highly-engineered structures such as bridges, stadiums, and high-rise structures.

Although these known methods are effective in providing high-quality building structures, it is submitted that their cost is excessive and somewhat time-consuming in preparation. Moreover, the concrete is ultimately exposed to the elements which contributes to the deterioration of the entire structure. Current construction methods do not adequately provide a reliable and easy low-cost way to build long-span concrete structures. Nor do current methods provide protection to the concrete material after it has set.

DISCLOSURE OF INVENTION

In light of the foregoing, it is a first aspect of the present invention to provide a long-span in-situ concrete structure and method for constructing the same.

It is another aspect of the present invention to provide a long-span concrete structure extending between supporting structures such as beams, walls, piers, and the like.

It is a further aspect of the present invention to provide for the in-situ forming of long-span structures, as set forth above, which are assembled on site, are cost effective to assemble, and provides significant protection from natural elements upon completion of the construction.

It is yet another aspect of the present invention to provide a long-span concrete structure, as set forth above, in which a form support extends between and is coupled to the supporting structures.

It is still another aspect of the present invention to provide a long-span structure, as set forth above, which utilizes a form hanger that is frictionally assembled to the form support along the length thereof between the supporting structures.

It is still a further aspect of the present invention to provide a long-span structure, as set forth above, to suspend a beam form from the form hangers along the entire length of the form support between the supporting structures.

It is an additional aspect of the present invention to provide a long-span structure, as set forth above, to employ a form support positioned between the form support and the bottom of the beam form to maintain medial spacing between the form support and the beam form.

It is still yet another aspect of the present invention to provide a long-span structure, as set forth above, in which a deck form is assembled onto the top of the beam forms and supported thereby so as to receive concrete material within the beam form and on the deck so as to form the span between the supporting structures.

It is yet another aspect of the present invention to provide a long-span structure, as set forth above, wherein a deformed cable conduit is carried by the beam form and is capable of carrying a cable. The cable conduit precludes entry of the concrete material into the conduit during the assembly of the long-span structure. The conduit may be a single, double, or a plurality of tubes so as to allow for receipt of a cable in each one.

It is yet a further aspect of the present invention to provide a long-span structure, as set forth above, wherein the cable received within the conduit is tensioned or pre-stressed a predetermined amount against the previously poured and set concrete and whereupon concrete material is filled into the conduit. After setting of the concrete within the conduit, the tension applied to the cables is released so as to transfer the pre-stress from the cable to the initially poured concrete.

It is still yet a further aspect of the present invention, as set forth above, to provide mating hooks on the form hangers and the beam forms to assist in their assembly and wherein the beam forms are made of a plastic or polymeric material which protects the concrete after it has taken a set.

In a variation of the present invention, it is another aspect to provide the beam forms with side supports between the supporting structures.

It is another aspect of the present invention, as above, to configure the side supports such that they are braced to each other to maintain proper spacing therebetween and assist in carrying the beam forms.

It is still another aspect of the present invention, as above, to provide a tension plate at each end of the beam form to assist in tensioning cables placed in the beam form against the side supports, prior to receipt of concrete therein.

It is yet another aspect of the present invention, as above, to position the form support horizontally in the beam form and provide pegs vertically extending from the form. After the setting of the concrete within the form, the tension applied to the cables is released so as to transfer the stress from the cables to the span.

The foregoing and other aspects of the present invention, which shall become apparent as the detailed description proceeds, are achieved by a long-span concrete structure extending between supporting structures, comprising at least one form support extending between the support structures, and at least one beam form carried by the support structures and partially enclosing the corresponding form support, wherein concrete is receivable in said beam form to form the long-span concrete structure.

The present invention also provides a long-span structure formed in-situ and extending between supporting structures, comprising at least one form support extending between the supporting structures, wherein each end of said form support includes a bearing plate coupled to the adjacent supporting structure, a plurality of form hangers frictionally engaging said form supports, each said form hanger having upwardly extending hooks, and a beam form carried by said plurality of form hangers and extending the length of each said form support, each said beam form having opposed side walls connected by a bottom to form a cavity, each sidewall having a downwardly extending hook mating with said upwardly extending hooks, wherein concrete is receivable at least in said beam form cavity to form the long-span structure.

The present invention further provides a method for constructing a long-span structure, comprising the steps of providing at least two supporting structures spaced a distance apart from each other, spanning said distance with at least one form support, supporting at least one beam form for each said form support and extending the entire length thereof, each said beam form having a cavity, and pouring concrete into said cavity to form the long-span structure across the distance.

These and other aspects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
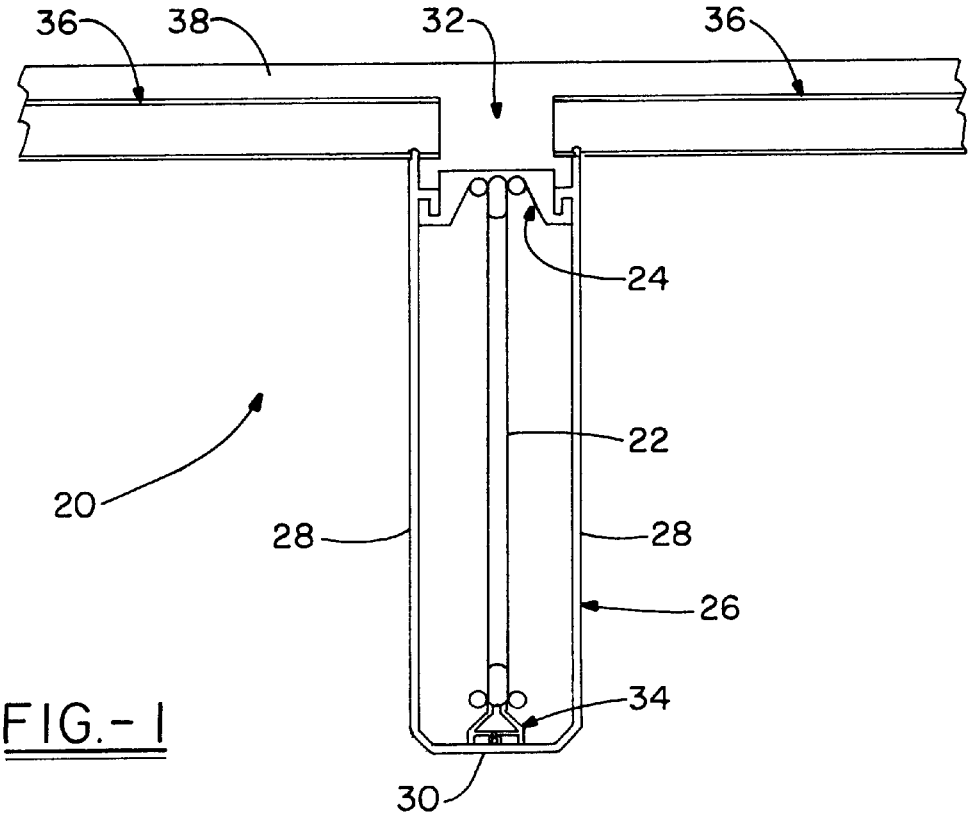
FIG. 1 is an elevational view, in cross-section, of a long-span concrete structure.

Referring now to the drawings and more particularly to FIG. 1, it can be seen that a long-span concrete structure employed in the construction of bridges, building floors, and the like, is designated generally by the numeral 20. Generally, the structure 20 includes a vertically-oriented form support 22 extending from or coupled to an existing or site-formed foundation or other support. The form support 22 could be a light-weight steel structure or a uniquely designed bar joist employing deformed bars. The form support 22 is of adequate structural strength to support itself and any concrete received therein. A form hanger 24 is snapped or pressed onto the form support 22 and is preferably of a plastic construction. A beam form 26 is suspended or carried by the form hanger 24 and in the preferred embodiment, is of a light-weight plastic construction. The beam forms may be made by either a pultrusion or extrusion process. The beam form 26 may be provided in sections and connected end-to-end so as to enclose the entire length of the form support 22. Each beam form 26 provides a pair of opposed side walls 28 connected at respective ends by a bottom 30. The side walls 28 and the bottom 30 form a beam cavity 32. As best seen in FIG. 1, a form spacer 34 may be positioned between the bottom surface of the form support 22 and the bottom 30 so as to maintain the form support in a medial position between the side walls 28. A deck 36 may be assembled onto the beam forms 26 while leaving the cavity 32 open so as to receive a structural material such as concrete 38 therein and upon the deck 36. Upon curing of the concrete 38, the long-span concrete structure is essentially complete. It will be appreciated that FIG. 1 shows only a single form support and beam form. Those skilled in the art will appreciate that multiple and substantially parallel form supports and beam forms may be employed depending upon the loads to be encountered by the long-span structure 20. Moreover, the deck 36 is an optional component of the complete long-span structure.

Figure 2:
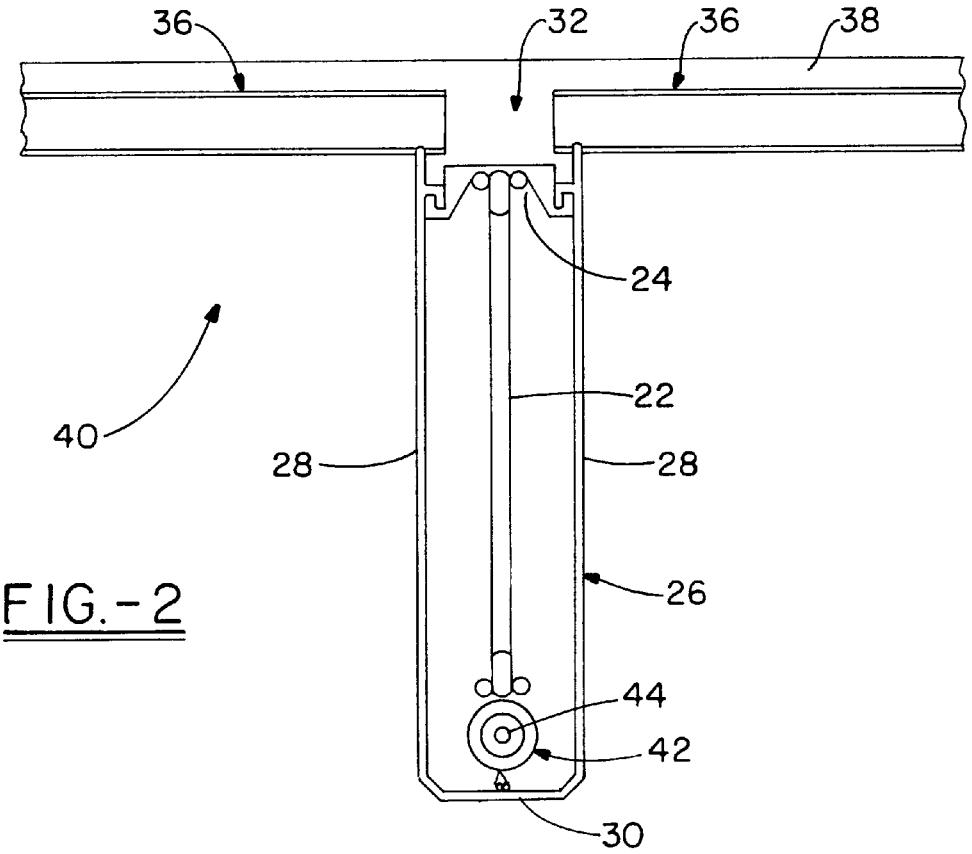
FIG. 2 is an elevational view, in cross-section, of an alternative long-span concrete structure.
Figure 3A:
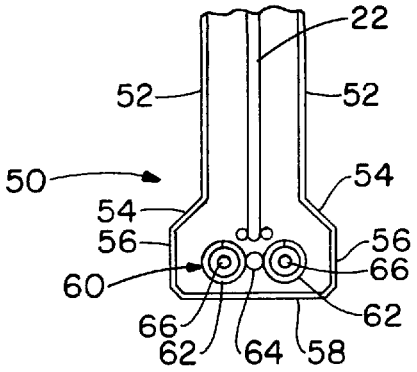
FIG. 3A is an elevational view of a beam form with a double-conduit.
Figure 3B:
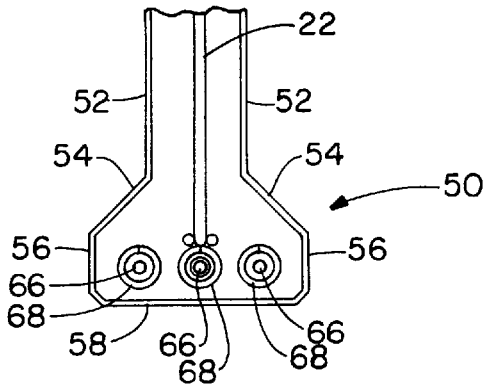
FIG. 3B is an elevational view of a beam form with a triple-conduit.

A similar long-span concrete structure can also be seen in FIG. 2 and is designated generally by the numeral 40. The only significant difference between the structure 40 shown in FIG. 2 and the structure 20 shown in FIG. 1 is the inclusion of a deformed cable conduit 42 employed in place of the form spacer 34. The cable conduit 42 provides an opening for receiving a cable 44 which may be employed as a tensioning device to increase the strength of the long-span concrete structure. Particular details of tensioning the entire structure through the use of the cable conduit 42 and the cable 44 is discussed in further detail below.

Where additional strength is required to be imparted to the long-span concrete structure, variations of the beam form 26 may be employed. These variations are best seen in FIGS. 3A and 3B, which show an alternative beam form designated generally by the numeral 50. The form 50 includes opposed side walls 52 from which extend shoulders 54. The shoulders 54 provide a sloping angle so as to allow rain and snow to be deflected off the beam form 50. More importantly, the indentations formed by the shoulders 54 remove unneeded weight from the finished span. Sloping of the shoulder minimizes the potential for cracks at the corners. Extending further and down from the shoulders 54 are arm sides 56 which are connected to one another by a bottom 58. As seen in FIG. 3A, a double conduit construction is designated generally by the numeral 60. The conduit 60 includes a pair of side-by-side tubes 62 which are interconnected by a web member 64. Both of the tubes 62 receive a cable 66 which may be tensioned by the method to be discussed below. FIG. 3B presents another alternative construction wherein three individual conduits are disposed or carried by the bottom of the beam form 50. The three conduits may be solitary conduit members 68 or may be side-by-side conduits constructed with interconnecting web members as shown in FIG. 3A. It will be appreciated by those skilled in the art that any number of conduits may be included within the beam form and that they may be incorporated into various positions as required by the loads anticipated to be applied to the structure.

Figure 4:
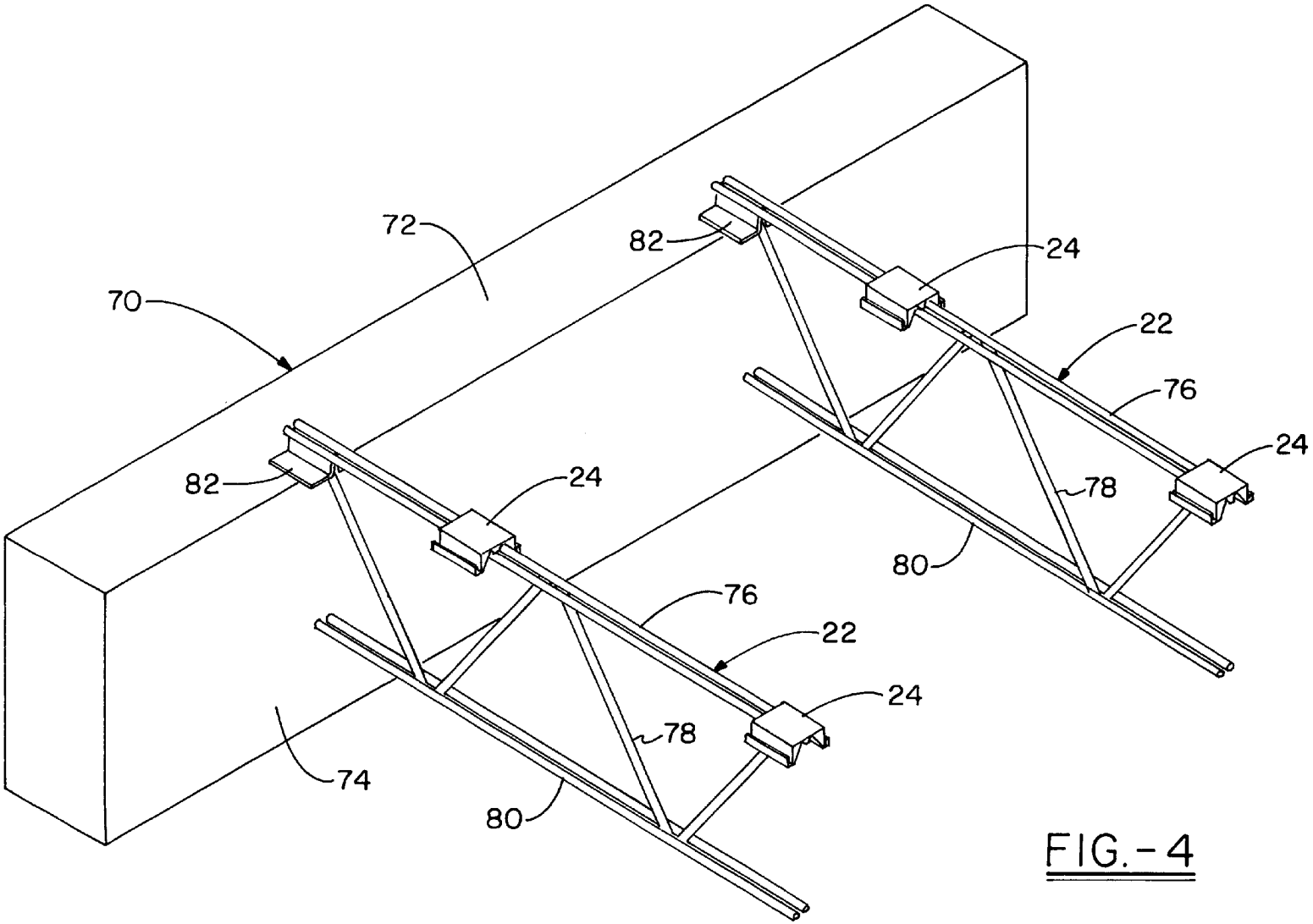
FIG. 4 is a perspective view of a single supporting structure and form supports coupled thereto.

Referring now to FIGS. 4–12, the assembly of a long-span concrete structure is described in detail. In particular, a pier or other similar supporting structure is designated generally by the numeral 70. As seen in FIG. 4, only one supporting structure 70 is shown, but it will be appreciated by those skilled in the art that a similar supporting structure supports the opposite end of the form supports 22. Each supporting structure 70 includes at least a top surface 72 and end walls 74.

A form support 22 is positioned or coupled to the structure 70. The form support 22 is either carried or attached during formation or after completion of the structure. It will be appreciated by those skilled in the art that the structure 70 may be a pre-existing structure or that it may be formed in conjunction with use of the long-span concrete structure disclosed herein. The form support 22 may be in the form of a bar joist, I-beam, T-beam, or any other similar supporting steel structure. In the present instance, a bar joist is shown which has a compression bar 76 with a structural bar 78 extending to a deform bar 80. As is known by those skilled in the art, the compression bar 76 provides compression reinforcement in the completed concrete member and is shaped to receive the form hanger 24. Other usual structural shapes for the compression bar 76 include, but are not limited to, a channel, an angle, or I-beam construction. The structural bar 78 serves as a web member to support and provide horizontal sheer reinforcement in the finished concrete structure. The deform bar 80 serves as a tensile member in the form support 22 and also as tensile reinforcement in the completed concrete structure. Further, the form support 22 may be provided with a camber or slight arc between the supporting structures. The form support 22 may include a bearing plate 82 which extends from the compression bar 76 at each end so as to be carried by the supporting structure 70 in a manner well known in the art.

Figure 5:
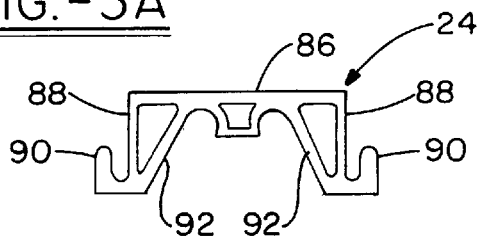
FIG. 5 is an elevational view of a form hanger according to the present invention.

As best seen in FIGS. 4 and 5, the form hangers 24 are strategically placed along the length of the compression bar 76. The form hangers are preferably made of a light-weight plastic material similar to that used for the beam form 26. The form hanger 24 includes a plate 86 with downwardly extending ends 88. A hook 90 extends upwardly from each end 88 and wherein the hook 90 is reinforced by support members 92 extending between the hook and the plate 86. The support members 92 form channels 94 which conform to the shape of the compression bar 76. As such, the form hangers are easily connected to the form support 22.

Figure 6:
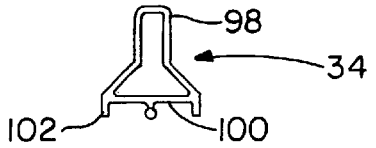
FIG. 6 is an elevational view of a form spacer according to the present invention.

As seen in FIG. 6, the form spacer 34, which is positioned between form support 22 and the beam form 26, includes a body 98 extending from a base 100. Extending in a direction opposite the body 98, the base 100 provides a series of tabs 102.

Figure 7:
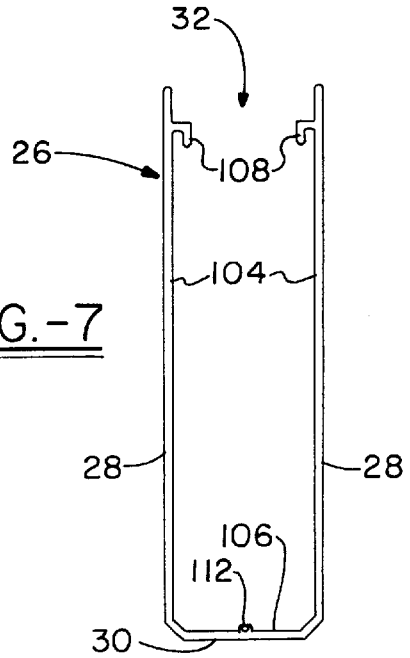
FIG. 7 is an elevational view of a beam form according to the present invention.

Referring now to FIG. 7, it can be seen that the opposed walls 28 provide interior wall surfaces 104 that are connected to one another by an interior bottom 106. A hook 108 extends downwardly from each of the interior wall surfaces 104 and mates with the downwardly extending hooks 90 provided by the form hanger 24. It will be appreciated that the beam form is somewhat flexible at its bottom 30 so as to allow the hooks 108 to engage the hooks 90. To ensure medial spacing of the deck form with respect to the form support, the bottom 30 provides upwardly extending nubs 112 which engage the tabs 102 provided by the form spacer 34.

Figure 8:
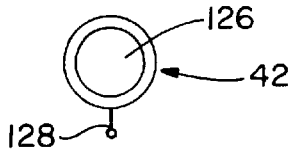
FIG. 8 is a side elevational view of a conduit disposable between the form spacer and the beam form.
Figure 9:
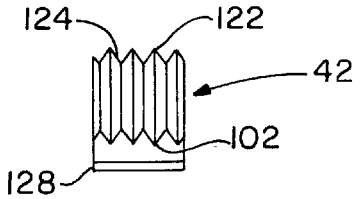
FIG. 9 is an end view of the cable conduit.
Figure 12:
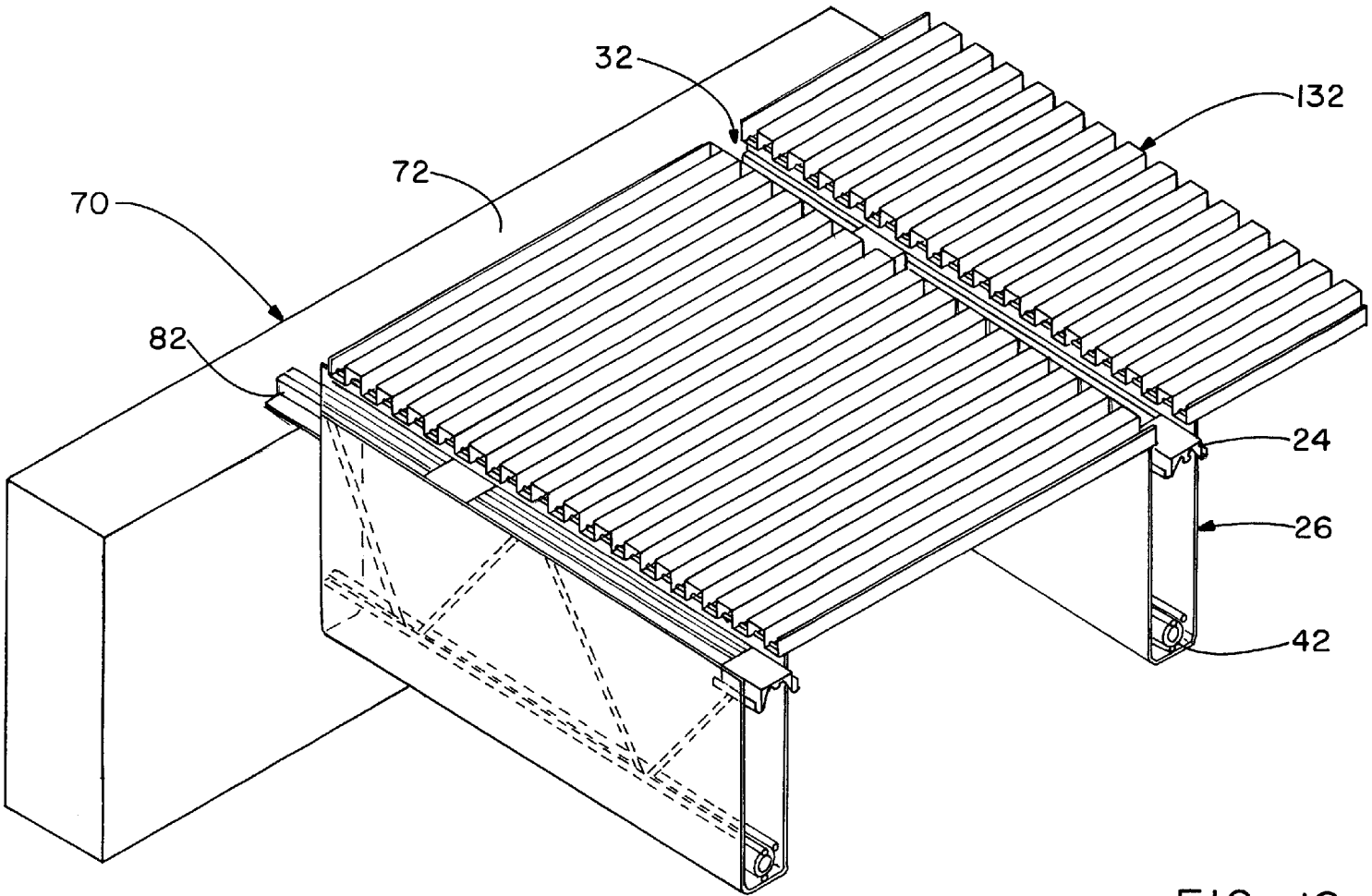
FIG. 12 is a perspective view, partially fragmented, of an assembled long-span structure prior to receipt of concrete.

Referring now to FIGS. 8, 9, and 12, it can be seen that the conduit 42 may be employed in place of the spacer 34. The conduit 42 is enclosed along its entire length and provided with a deformed structure. In particular, the conduit 42 has a ribbed wall 120 which has an outer rib 122 alternating with an inner rib 124. The rib wall 120 forms a void 126 for receiving the cable 44. The deformed structure of the conduit 42 may be provided in other manners such as a serpentine channel configuration, with horizontal and vertical ribs, or any other such protuberances for engaging the concrete poured into the cavity 32. It will be appreciated that the conduit is enclosed so as to preclude entry of the concrete poured into the cavity 32 into the void 126. Extending downwardly from the conduit 42 is a flange 128 which fits within the nubs 112. In the preferred embodiment, the conduit 42 is placed along the bottom surface of the beam form 26 to maximize the strength of the finished span.

Figure 10:
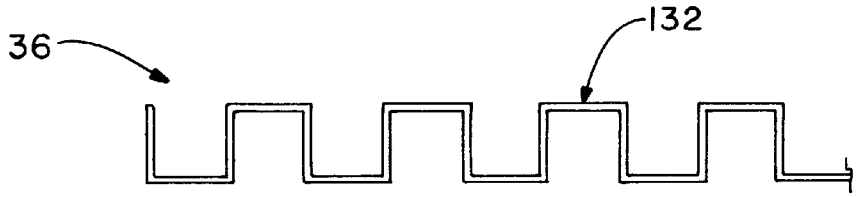
FIG. 10 is an elevational view of a deck form according to the present invention.
Figure 11:
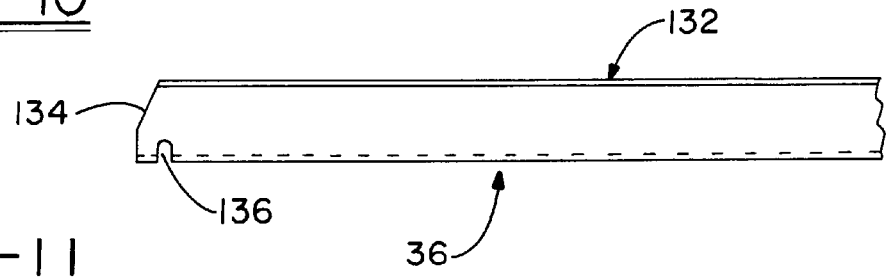
FIG. 11 is a side view of the deck member according to the present invention.

Referring now to FIGS. 10 and 11, it can be seen that the deck form 36 is a substantially corrugated member 132. The corrugations provide added strength to the deck and ultimately to the long-span structure. The deck 36 may be provided with a chamfer end 134 and a notch 136 extending along an edge thereof. The notch 136 is sized to fit onto the side wall 28 so that the deck form 36 is held in place during assembly and pouring of the concrete.

Once the major components are assembled to one another, as best seen in FIG. 12, the concrete 38 is poured into the cavity 32 to fill the beam form 26 and then over the deck form 36. Once the concrete 30 has set, the structure is ready for use.

Figure 13:
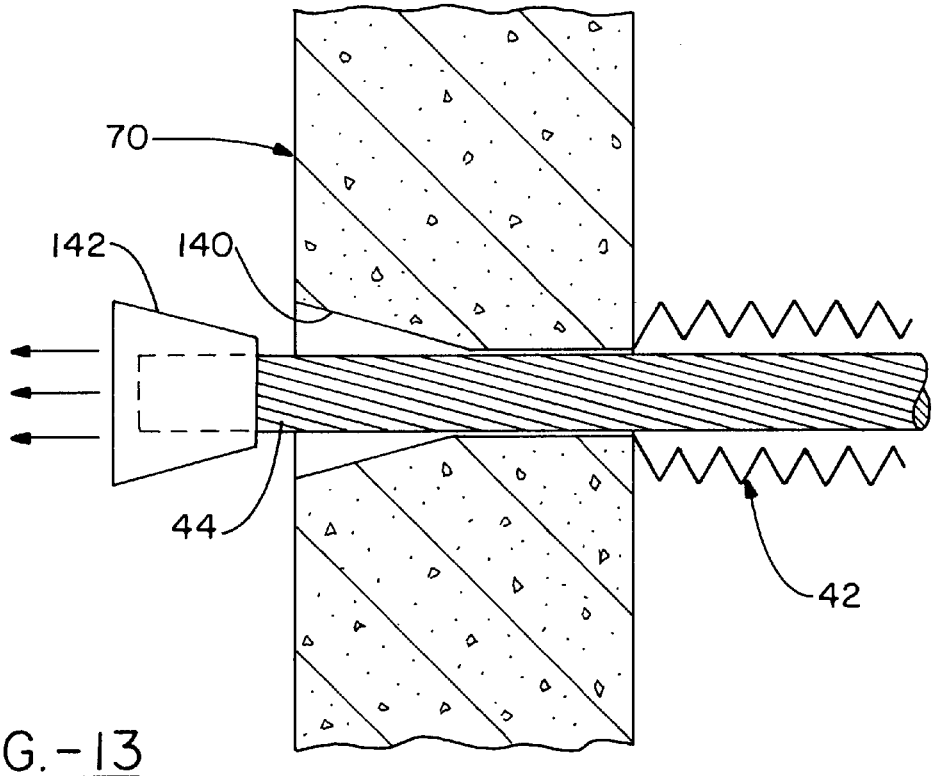
FIG. 13 is a cross-sectional view of a cable within a cable conduit.

In order to strengthen the structural integrity of the span and ensure maximum performance, a pre-stress may be applied to the entire structure. This is accomplished by first directing the tension cable 44 through the cable conduit 42. The cable 44 is typically provided as rebar or other deformed structure which allows for bonding to concrete material. After the rebar or cable 44 is directed through the conduit 42, one end of the cable is secured or held at one supporting structure 70 and the other end of the cable is pulled or tensioned by a tensioning device. As best seen in FIG. 13, an access hole 140 is provided through the supporting structure 70. A tension device 142 then pulls on the cable and imparts a tension or pre-stress. Concrete with the desired structural properties is then pumped into the hole 140 through the structure 70 and into the cable conduit 42 so that it is completely filled. The solidified concrete engages both the cable 44 and the inner and outer ribs 122 and 124. In other words, there is a mechanical engagement between the concrete and cable deformations and between the concrete and the inner and outer ribs. After the concrete has set within the cable conduit 42, the tensioning device 142 releases the stress applied to the cable 44 and the tension is then transferred to the beam form 26, the deck form 36 and the attached concrete material.

It is apparent then from the above description of the structural components and method of assembling the components, that the long-span concrete structure disclosed herein provides numerous benefits. Primarily the concrete structures allow for on-site construction of a long-span at a low-cost. By employing hanging forms to form the beams of the structure, shipping of heavy pre-cast beams is eliminated. Moreover, this method eliminates the need for preparing a site and the need to build a supporting structure on the site. Yet another advantage of the present invention is the formation of a void in the initial construction or assembly of the span and wherein this void is later employed to impart a pre-stress to the entire structure and thereby, strengthen the complete assembly. Accordingly, a low-cost long-span concrete structure is easily manufactured using the components and techniques of this structure.

Figure 14:
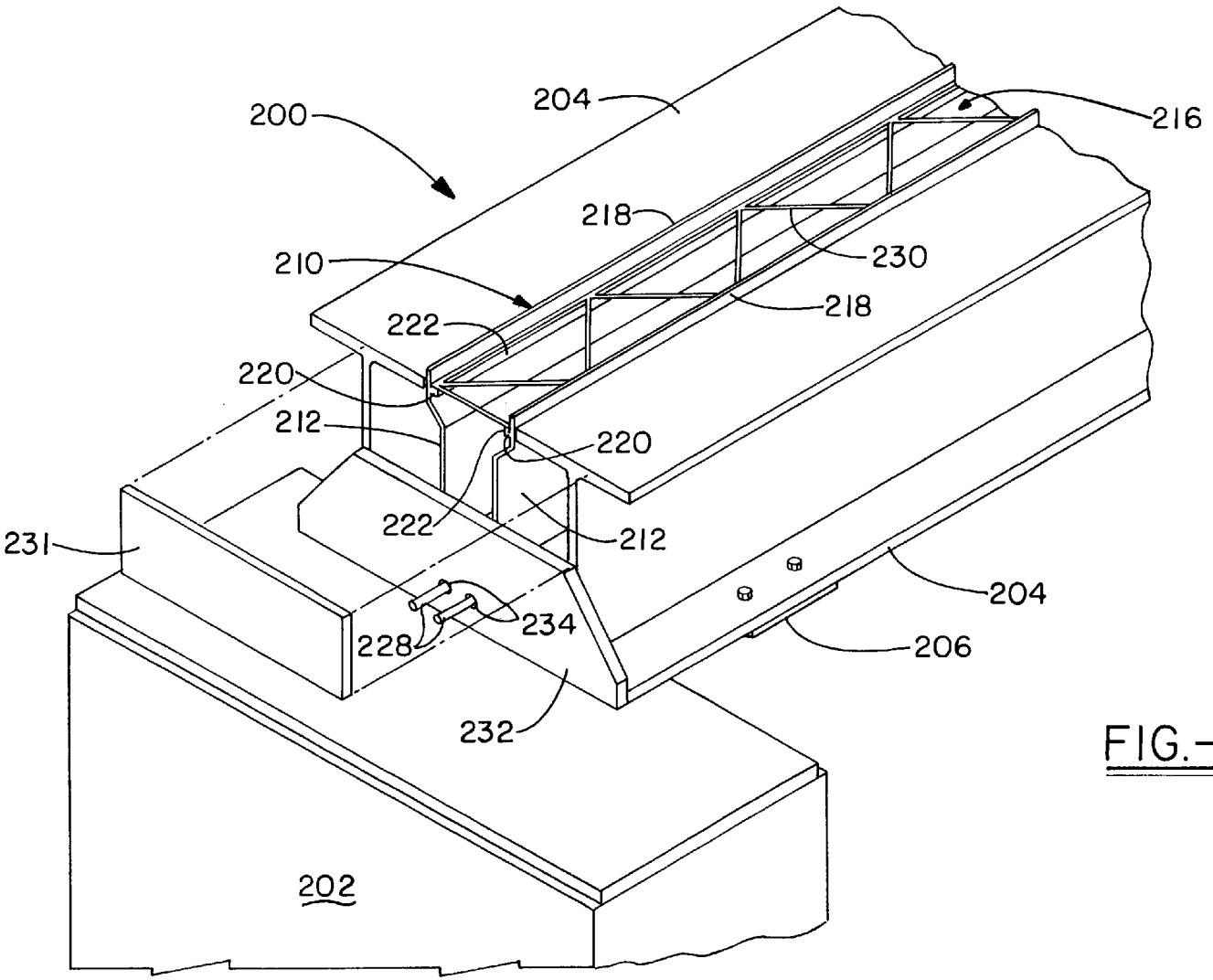
FIG. 14 is a perspective view of a beam form with associated supporting structure.
Figure 15:
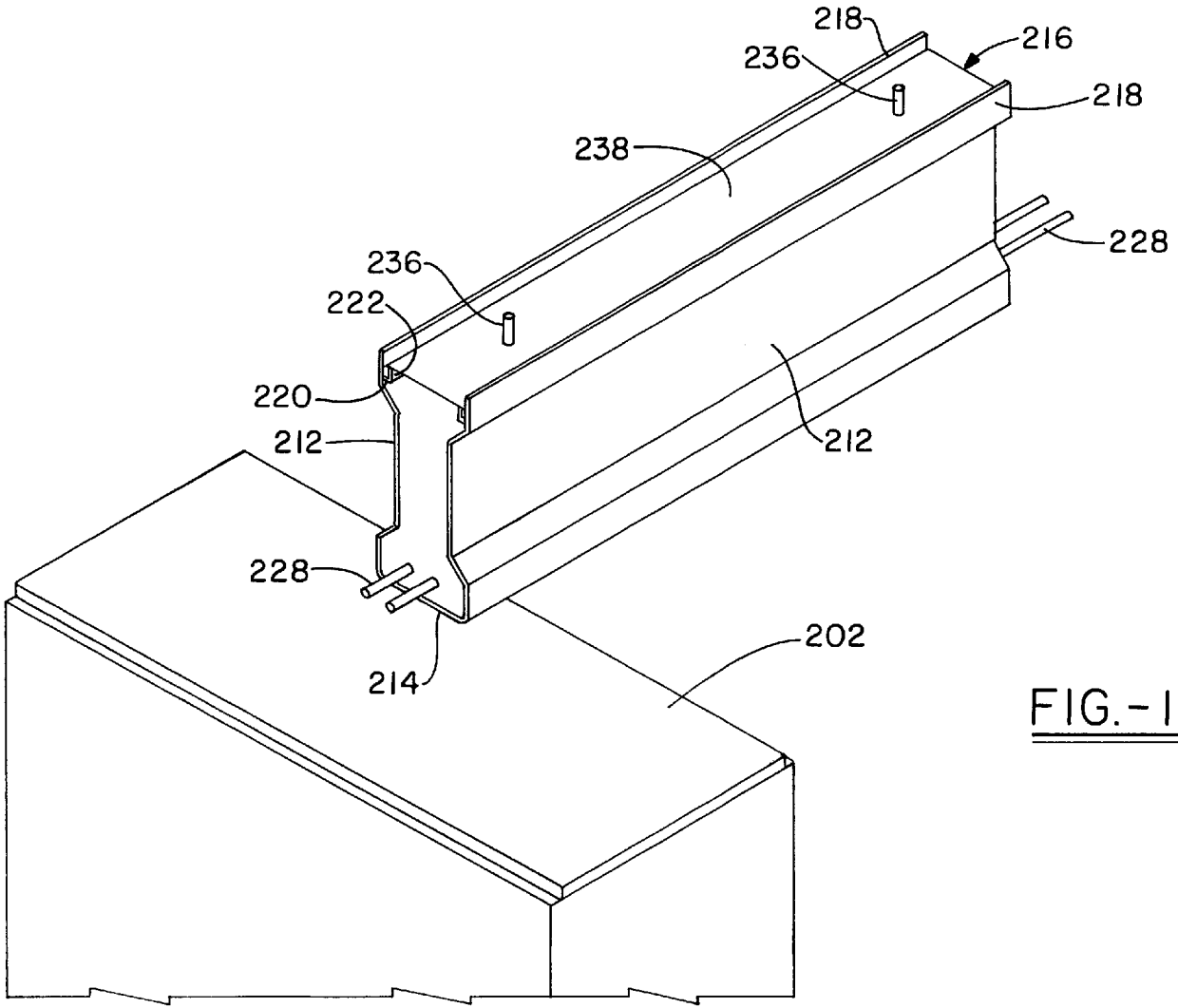
FIG. 15 is a perspective view of a beam form with its supporting structure removed.
Figure 16:
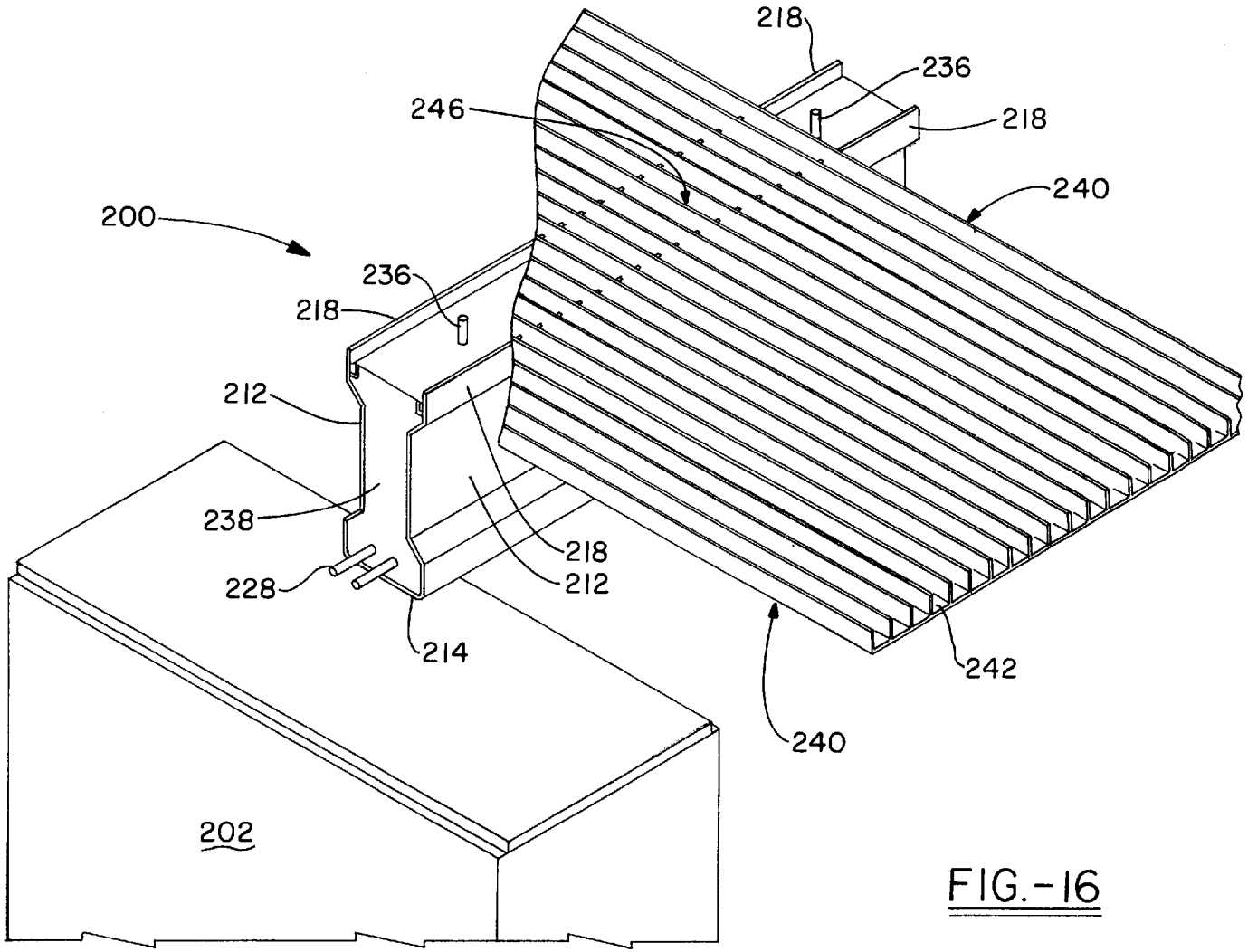
FIG. 16 is a perspective view of a deck form installed upon the beam form.

Referring now to FIGS. 14–16, it can be seen that a variation of a long-span structure is designated generally by the numeral 200. Assembly of the structure 200 requires the use of a wall, beam, or pier 202 at both ends of the structure, although only one is shown in FIG. 14. It will be appreciated that the opposite end of the structure 200 is supported by a pier or other similar supporting structure at an appropriate height. A pair of I-beams 204 are supported by the pier 202 and function as side supports in a manner to be described below. The I-beams or other similar supporting structure function to support the weight of the forms and concrete and as axial members against which cables or the like are tensioned. Ideally, the supporting structure is strong in both bending and axial compression. A brace 206 is bolted to the underside of each I-beam 204 to support a later-installed form and to maintain position and spacing between the I-beams and to prevent lateral movement thereof during formation of the structure 200.

A beam form, designated generally by the numeral 210, is carried and supported by the I-beams 204 and brace 206. Of course, more than one beam form 210, each positioned end-to-end, may extend between the piers 202. Although the beam form 210 is carried by the I-beams 204, it will be appreciated that other structural shapes may be employed to support the beam form 210. For example, a T-shaped beam, a rectangular flat plate, or a bar joist may be employed to support each side of the beam form 210. Each beam form 210 has a pair of opposed sides 212 connected by a bottom 214. The sides 212 and the bottom 214 form a cavity 216 which later receives concrete or other material. Each side 212 provides a top edge 218 that includes an inner side ledge 220 which extends inwardly toward the other side. Each side ledge 220 provides a ledge rim 222 which extends upwardly and is substantially parallel with the top edge 218.

In the assembly of the structure 200, at least one deformed cable 228, such as reinforcing bar or "rebar," runs over the entire length of the form 210 and rests on the bottom 214. Of course, more than one cable 228 may be disposed within the beam form 210. Next, a form support 230 is positioned in the beam form 210. In particular, the form support 230 is horizontally oriented within the form 210 such that its edges are carried by the side ledge 220 and the ledge rim 222. Positioning of the form support 230 in this manner maintains the spacing of the top portion of the structure 200 so that it does not deform or collapse during receipt of the concrete material. Prior to receipt of the concrete material, a tension plate 232 is positioned at each end of the structure 200. The tension plate 232 is provided with a hole 234 corresponding to the number of cables 228 disposed within the form 210. Also at this time, vertically oriented reinforcing bar pegs 236 may be installed within the beam form 210 at various locations along the length of the structure 200. At this time and in a manner consistent with the method discussed above, the cables 228 are tensioned or tightened by pulling them outwardly and utilizing the tension plate 232 and the I-beams 204 as a stationary force. At this time, a cover 231 is placed upon the remaining open end portion of the beam form 210 that is not covered by the tension plate 232. Concrete 238 is then poured into the beam form 210 so as to cover the cables 228 and the form support 230.

After the concrete has set, the cover plate 231 and the tension plate 232 is removed and the stress within the cables 228 is imparted to the entire structure 200. At this time, the I-beams 204 and brace 206 are removed from the completed beam form 210.

Referring now to FIG. 16, it can be seen that a deck form, generally designated by the numeral 240, is installed on the formed beam. Although only one formed beam is shown, it will be appreciated by those skilled in the art that any number of beams may be spanning the piers 202 as needed by the end use. The deck form 240 includes a plurality of channels 242 in a generally corrugated-type shape. The deck form 240 is also provided with a plurality of openings approximately every other channel and wherein the openings 246 are positioned over the top surface of the formed beam. As can be seen, the pegs 236 extend through the openings 246 and into the channels 242. At this time, additional concrete material 238 is disposed onto the deck form 240 to surround and cover the pegs and proceed into the openings 246 and allowed to set. Alternatively, the deck form 240 could be provided to engage just the top edge of the forms. This would allow placement of the forms 240 before placement of the concrete. As such, the concrete could be poured all at once with or without the pegs 236.

The structure 200 presented in FIGS. 14–16 has many of the same advantages as the long-span structures presented in the other figures. One additional benefit of the present structure is that it does not require the use of an additional conduit and can be completed without the need for additional pours of concrete. It will also be appreciated that the I-beams used to support the side of the formed beam may be employed as compression members during the tensioning of the cables 228.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A long-span concrete structure extending between supporting structures, comprising:

at least one form support extending between the support structures;

at least one in-situ beam form carried by the support structures and partially enclosing the corresponding form support, wherein concrete is receivable in said beam form to form the long-span concrete structure;

a plurality of form hangers carried by said form support, said beam forms suspended from said form hangers; and an internal form spacer positionable between each said form support and said corresponding beam form to maintain uniform spacing therebetween.

2. The structure according to claim 1, further comprising:

at least one enclosed cable conduit carried by said beam form which precludes entry of concrete that fills the beam form;

a cable received in said cable conduit, wherein said cable conduit includes latitudinal ribs for engaging concrete that fills the beam form, and wherein concrete is separately receivable in said conduit and engages to said latitudinal ribs and said cable.

3. The structure according to claim 1, wherein said cable is pre-stressed prior to receipt of the concrete in said conduit.

4. A long-span concrete structure extending between supporting structures, comprising:

at least one form support extending between the support structures;

at least one beam form carried by the support structures and partially enclosing the corresponding form support, wherein concrete is receivable in said beam form to form the long-span concrete structure;

an enclosed cable conduit positionable between each said form support and said corresponding beam form to maintain uniform spacing therebetween and to preclude entry of concrete that fills the beam form, said cable conduit having latitudinal ribs; and a cable received in said cable conduit, wherein said latitudinal ribs bond to concrete that fills the beam form, and wherein concrete is separately receivable in said conduit which bonds to said latitudinal ribs and said cable.

5. The structure according to claim 1, further comprising:

a deck supported by at least one said form support, wherein concrete is receivable in said at least one beam forms and on said deck.

6. The structure according to claim 1, wherein each said beam form provides opposed inner side ledges for carrying said form support.

7. The structure according to claim 6, further comprising:

a plurality of pegs extending from said beam forms and through said deck.

8. A long-span structure formed in-situ and extending between supporting structures, comprising:

at least one form support extending between the supporting structures, wherein each end of said form support includes a bearing plate coupled to the adjacent supporting structure;

a plurality of form hangers frictionally engaging said form supports, each said form hanger having upwardly extending hooks; and an in-situ beam form carried by said plurality of form hangers and extending the length of each said form support, each said in-situ beam form having opposed side walls connected by a bottom to form a cavity, each sidewall having a downwardly extending hook mating with said upwardly extending hooks, wherein concrete is receivable at least in said beam form cavity to form the long-span structure.

9. The structure according to claim 8, further comprising:

a form spacer positioned between said bottom of said beam form and said form support to maintain said form spacer in a substantially middle position within said beam form.

10. The structure according to claim 8, further comprising:

at least one latitudinally ribbed and enclosed cable conduit positioned between said bottom of said beam form and said form support to maintain said form support in a substantially middle position within said beam form.

11. The structure according to claim 10, further comprising:

a deformed cable received in said cable conduit and pre-stressed prior to said deformed cable conduit receiving concrete, wherein the tension applied to said deformed cable is released after the concrete received in said conduit is set.

12. The structure according to claim 8, further comprising:

a latitudinally ribbed and closed double cable conduit carried by said bottom of said beam form, said double cable conduit having side-by-side tubes connected by a web member, said double cable conduit positioned between said bottom of said beam form and said form spacer to maintain said form spacer in a substantially middle position within said beam form.

13. The structure according to claim 12, further comprising:

a deformed cable received in each said tube and pre-stressed prior to said tubes receiving concrete, wherein tension applied to said deformed cables is released after the concrete received in said tubes is set.

14. The structure according to claim 8, further comprising:

another form support and another beam form assembled with another plurality of form hangers to form at least another long-span structure; and a deck supported by the long-span structures with said beam form cavities remaining open, wherein concrete is removed in said beam forms and on said deck.

15. A method for constructing a long-span structure, comprising:

providing at least two supporting structures spaced a distance apart from each other;

spanning said distance with at least one form support;

supporting at least one beam form for each said form support and extending the entire length thereof, each said beam form having a cavity;

positioning a latitudinally ribbed, enclosed cable conduit within said cavity, wherein said cable conduit precludes entry of concrete therein;

pouring concrete into said cavity to form the long-span structure across the distance;

inserting a cable into said cable conduit;

stressing said cable;

pouring concrete into said cable conduit; and releasing the stress on said cable after the concrete in said cable conduit has set.

16. The method according to claim 15, further comprising the step of:

disposing a plurality of form hangers on each said form support, wherein said beam forms are suspended from said plurality of form hangers.

17. The method according to claim 15, wherein said form hanger has an upwardly extending hook and said beam form has a downwardly extending hook, said suspending step comprising the step of:

mating said downwardly extending hook with said upwardly extending hook.

18. A method for constructing a long-span structure, comprising:

providing at least two supporting structures spaced a distance apart from each other;

extending a pair of side supports between the at least two supporting structures;

spanning said distance with at least one form support between said at least two supporting structures;

supporting at least one in-situ beam form from each said form support and between said at least two supporting structures and extending the entire length thereof, each said in-situ beam form having a cavity;

pouring concrete into said cavity to form the long-span structure across the distance; and removing said pair of side supports after the concrete has set.

19. The method according to claim 18, further comprising the step of:

disposing at least one cable in said beam form and applying tension thereto prior to said step of pouring.

20. The method according to claim 19, further comprising the step of:

releasing the stress on said cable after the poured concrete has set.

21. The method according to claim 18, further comprising the step of:

connecting each said pair of side supports to one another with a brace to maintain desired spacing between said pair of side supports.

22. The method according to claim 15, further comprising the steps of:

spanning said distance with at least a second form support;

disposing a deck form upon said beam forms; and pouring concrete onto said deck.

* * * * *